United States Patent [19]

Langley et al.

[11] Patent Number: 4,913,775

[45] **Date of Patent: * Apr. 3, 1990**

[54] PRODUCTION OF PAPER AND PAPER BOARD

[75] Inventors: John Langley; David Holroyd, both of West Yorkshire, England

[73] Assignee: Allied Colloids Ltd., Great Britain

[ * ] Notice: The portion of the term of this patent subsequent to Jun. 28, 2005 has been disclaimed.

[21] Appl. No.: 211,780

[22] Filed: Jun. 27, 1988

Related U.S. Application Data

[63] Continuation-in-part of Ser. No. 6,953, Jan. 27, 1987, Pat. No. 4,753,710.

[30] Foreign Application Priority Data

Jun. 29, 1986 [GB] United Kingdom ..... 8602121
Mar. 28, 1988 [GB] United Kingdom ..... 8807444

[51] Int. Cl.[4] ..... D21H 3/36

[52] U.S. Cl. ..... 162/164.3; 162/164.6; 162/168.2; 162/168.3; 162/181.8; 162/183

[58] Field of Search ..... 162/164.3, 164.6, 168.2, 162/168.3, 181.8, 183

[56] References Cited

U.S. PATENT DOCUMENTS

| | | | |
|---|---|---|---|
| 2,368,635 | 2/1945 | Booth | 92/21 |
| 3,052,595 | 9/1962 | Pye | 162/164 |
| 3,433,704 | 3/1969 | Hecklau et al. | 162/181 |
| 4,388,150 | 6/1983 | Sunden et al. | 162/175 |

FOREIGN PATENT DOCUMENTS

| | | |
|---|---|---|
| 17353 | 10/1980 | European Pat. Off. . |
| 141641 | 5/1985 | European Pat. Off. . |
| 1546237 | 7/1969 | Fed. Rep. of Germany . |
| 2262906 | 10/1973 | Fed. Rep. of Germany . |
| 67735 | 1/1985 | Finland . |
| 67736 | 1/1985 | Finland . |
| 1265496 | 3/1972 | United Kingdom . |
| WO 86/05826 | 10/1986 | World Int. Prop. O. . |

OTHER PUBLICATIONS

Chemical Abs. 101:157112.
Chemical Abs. 83:133772 p.
Arledter, Papier, vol. 29, No. 10a, Oct. 1975, pp. 32–43 and translation of p. 36 only.
Auhorn, Wochenblatt Fur Papierfabrikation, vol. 13, 1979, pp. 493–502 and translation of p. 500 only.
Tanaka, Tappi, Apr. 1982, vol. 65, No. 4, pp. 95–99.
Waech, Tappi Journal, Mar. 1983, pp. 137–139.
Luner, Tappi Proceedings, 1984 Paper Makers Conference, pp. 95–106.
Compozil trade literature.
Paper, Sep. 9, 1985, pp. 18–20.
Pummer, Papier, 27, vol. 10, 1973, pp. 417–422 and translation.
Damhaug, Abstract Bull. of the Institute of Paper Chemistry, vol. 51, No. 11, May 1981, p. 1161, Abstract No. 10862.
Stratton, Tappi Journal, vol. 66, No. 3, Mar. 1983, pp. 141–144 Effect of Agitation on Polymer Additives.
Auhorn, Wet Formation, Drainage and Drying–Improved with the Aid of Chemical Products, West End Paper Technology Symposium, Munich, Mar. 17–19, 1981.
Sikora, The Stability of Flocculated Colloids, Tappi Journal, vol. 64, Nov. 11, 1981, pp. 97–101.
Britt, Physical and Chemical Relationships in Paper Sheet Formation, Tappi Journal, vol. 63, No. 5, May 1980, pp. 105–108.
Langley, Dewatering Aids for Paper Applications, Abstract Bulletin of the Institute of Paper Chemistry, vol. 57, No. 38, Sep. 1986, p. 364, Abs. No. 3105 or Tappi Papermakers Conf., Apr. 1986, Notes, 89–92.

*Primary Examiner*—Peter Chin
*Attorney, Agent, or Firm*—Ostrolenk, Faber, Gerb & Soffen

[57] ABSTRACT

Paper or paper board is made by passing an aqueous cellulosic suspension through a centriscreen or other shear device and then draining the purified suspension, and an improved combination of retention, drainage, drying and formation is achieved by adding to the suspension an excess of high molecular weight linear synthetic cationic polymer before shearing the suspension and adding bentonite after shearing.

16 Claims, No Drawings

PRODUCTION OF PAPER AND PAPER BOARD

This application is a continuation-in-part of our application Ser. No. 6953 filed 27th Jan. 1987, now U.S. Pat. No. 4,753,710.

This invention relates to the production of paper and paper board from a thin stock (a dilute aqueous suspension) of cellulose fibres and optionally filler on paper making apparatus in which the thin stock is passed through one or more shear stages such as cleaning, mixing and pumping stages and the resultant suspension is drained through a wire to form a sheet, which is then dried. The thin stock is generally made by dilution of a thick stock that is formed earlier in the process. The drainage to form the sheet may be downwards under gravity or may be upwards, and the screen through which drainage occurs may be flat or curved, e.g., cylindrical.

The stock is inevitably subjected to agitation throughout its flow along the apparatus. Some of the agitation is gentle but some is strong as a result of passage through one or more of the shear stages. In particular, passage of the stock through a centriscreen inevitably subjects the stock to very high shear. The centriscreen is the name given to various centrifugal cleaner devices that are used on paper machines to remove coarse solid impurities, such as large fibre bundles, from the stock prior to sheet formation. It is sometimes known as the selectifier. Other stages that apply shear include centrifugal pumping and mixing apparatus such as conventional mixing pumps and fan pumps (i.e., centrifugal pumps).

It is common to include various inorganic materials, such as bentonite and alum, and/or organic materials, such as various natural or modified natural or synthetic polymers, in the thin stock for the purpose of improving the process. Such materials can be added for diverse purposes such as pitch control, decolouration of the drainage water (JP 598291) or for facilitating release from drying rolls (JP 7559505). Starch is often included to improve strength.

Process improvement is particularly desired in retention, drainage and drying (or dewatering) and in the formation (or structure) properties of the final paper sheet. Some of these parameters are in conflict with each other. For instance if the fibres are flocculated effectively into conventional, relatively large, flocs then this may trap the fibre fines and filler very successfully, so as to give good retention, and may result in a porous structure so as to give good drainage. However the porosity and large floc size may result in rather poor formation, and the large fibre flocs may tend to hold water during the later stages of drying such that the drying properties are poor. This will necessitate the use of excessive amounts of thermal energy to dry the final sheet. If the fibres are flocculated into smaller and tighter flocs then drainage will be less satisfactory and retention usually will be less satisfactory, but drying and formation will be improved.

Conventional practice therefore has resulted in the paper maker selecting his additives according to the parameters that he judges to be the most important. If, for example, increased filler retention is more important to the papermaker than increased production he is more likely to use a polyacrylamide or other very high molecular weight flocculant. If increased production is more important than increased retention then a coagulant such as aluminum sulphate is more likely to be chosen. Impurities in the stock create additional problems and necessitate the use of particular additives.

It is known to include in the stock both an inorganic additive and an organic polymeric material, for the purpose of improving retention, drainage, drying and/or formation.

In DE 2262906, 1 to 10% bentonite and/or 0.5 to 3% aluminium sulphate is added to the stock, followed by 0.02 to 0.2% of a cationic polymer such as polyethylene imine, so as to improve dewatering even in the presence of impurities in the stock. (In this specification all percentages are dry weight based on the dry weight of the stock, unless otherwise stated.)

In U.S. Pat. No. 2,368,635, bentonite is added to the stock and may be followed by aluminium sulphate or other acidifying substance. In U.S. Pat No. 3,433,704, attapulgite is added and alum and/or auxiliary filler retention material can be incorporated. In GB 1,265,496, a stock containing alum and pigmentary clay is formed and cationic polymer is added.

In U.S. Pat. No. 3,052,595, mineral filler, polyacrylamide and 1 to 20% bentonite, by weight based on the weight of filler, are incorporated in the stock. It is stated that the polymer could be added to the stock either before or after the addition of fillers but the preferred process involves adding the bentonite to a stock containing the remainder of the fillers and the fibres, and then adding the polymer. In each instance the polymer is used in this process is substantially non-ionic polyacrylamide. In EP 17353, unfilled paper is made from crude pulp by adding bentonite to the stock followed by substantially non-ionic polyacrylamide.

FI 67735 describes a process in which a cationic polymer and an anionic component are included in the stock to improve retention and the resultant sheet is sized. It is stated that the cationic and anionic components can be pre-mixed but preferably the anionic component is first added to the stock followed by the cationic, or they are added separately at the same place. The stock is agitated during the addition. It is stated that the amount of cationic is 0.01 to 2%, preferably 0.2 to 0.9%, and the amount of anionic is 0.01 to 0.6%, preferably 0.1 to 0.5%. The cationic retention aid is said to be selected from cationic starch and cationic polyacrylamide or certain other synthetic polymers while the anionic component is said to be polysilicic acid, bentonite, carboxymethyl cellulose or anionic synthetic polymer. In the examples, the anionic component is colloidal silicic acid in an amount of 0.15% and the cationic component is cationic starch in an amount of 0.3 or 0.35% and is added after the colloidal silicic acid.

FI 67736 describes a process in which the same chemical types of materials are used as in FI 67735 but the size is added to the stock. It is again stated to be preferred to add the anionic component before the cationic component or to add both components at the same place (while maintaining the stock adequately agitated). However it is also stated that when synthetic polymer alone is used as the retention aid (i.e., presumably meaning a combination of synthetic cationic polymer and synthetic anionic polymer), it is advantageous to add the cationic before the anionic. Most of the examples are laboratory examples and show adding 0.15% colloidal silica sol to relatively thick stock, followed by 1 to 2% cationic starch followed by a further 0.15% colloidal silica sol. In one example, the 1–2% cationic starch is replaced by 0.025% cationic polyacrylamide and is added after part of the colloidal silica. In the only example of an actual production process, the cationic starch, filler and some anionic silica sol are all mixed into thick stock at the same place and the remainder of the silica sol is added later, but the precise points of addition, and the intervening process steps, are not stated.

Arledter in Papier, Volume 29, number 10*a*, Oct. 1975, pages 32 to 43, especially page 36, examined possible synergistic combinations of additives for cellulosic suspensions. He showed that when using a combination of 0.005% polyethylene oxide of very high molecular weight and 0.12% melamine formaldehyde resin, retention was improved only slightly if they were both added at the chest (early in the process), retention was improved if the melamine formaldehyde was added at the head box (near the end of the process) whilst the other polymer was still added at the chest, but best results were achieved when both polymers were added at the head box. Thus best results were obtained when no shear was applied after flocculation.

Auhorn in Wochenblatt Fur Papierfabrikation, Volume 13, 1979, pages 493 to 502, especially page 500, showed the use of bentonite in combination with 0.3% cationic polyelectrolyte. It appears that the bentonite absorbed impurities from the suspension prior to the addition of the polyelectrolyte. Chalk was said to behave in a similar manner. In a paper presented by Auhorn to the Wet End Paper Technology Symposium, Munich, 17th to 19th Mar. 1981, he showed that applying shear to the aqueous suspension after the addition of polymeric retention aid gave a serious decrease in retention properties. He also examined the effect of adding bentonite to the suspension and then adding 0.04% cationic polymer before or after the selectifier (a form of centriscreen). He demonstrated that greatly improved retention was obtained when the polymer was added after the selectifier (i.e., after the shearing) than before.

Tanaka in Tappi, Apr. 1982, Volume 65, No. 4, pages 95 to 99, especially page 98, indicated that when making paper filled with clay there was slightly better retention of clay when the clay was added after the polymer than before but warned that the system is highly shear sensitive.

Waech in Tappi Journal, Mar. 1983, pages 137 to 139 showed that when making paper filled with kaolin clay using a synthetic cationic polymeric retention aid, retention is significantly improved if all the kaolin is added after the retention aid instead of before. Waech also showed that retention is improved less if the retention aid is added before the fan pump.

Luner in Tappi Proceedings, 1984 Paper Makers Conference, pages 95 to 106, confirmed these results and suggested that they were due to the pulp being positively charged by the cationic polymer before the addition of anionic clay, and clearly demonstrated that although the process gave improved retention, it gave markedly reduced burst strength, compared to a process in which the clay is added before the retention aid.

The late addition of all the clay filler incurs other disadvantages. It would be very difficult in practice to operate this in a controlled manner because of the variable filler content of the recycled pulp that is used in many mills to supply part at least of the initial fibre pulp. It would be difficult or impossible to adapt paper mills to allow for the uniform addition of large amounts of filler at a late stage. Finally, these processes are of course inappropriate when no significant amount of filler is to be incorporated into the suspension, e.g., for unfilled papers.

In practice therefore, whenever a synthetic polymeric retention aid is included in the stock it is always added after the last point of high shear so as to avoid the dramatic loss of retention that is accepted as inevitable if the flocculated system is sheared and that is shown, as mentioned above, by Auhorn. In particular, the synthetic polymer retention aid is always added after the centriscreen.

In many of these processes a starch, often a cationic starch, is also included in the suspension in order to improve the burst strength. Whereas cationic synthetic polymeric retention aids are substantially linear molecules of relatively high charge density, cationic starch is a globular molecule having relatively low charge density.

A process that is apparently intended to obtain both good strength properties and satisfactory retention properties is described in U.S. Pat. No. 4,388,150 and uses colloidal silicic acid and cationic starch. It is said that the components may be pre-mixed and then added to the stock but that preferably the mixing is conducted in the presence of the stock. It is said that the best results are obtained if the colloidal silicic acid is mixed into the stock and the cationic starch is then added. It appears that a binder complex is formed between the colloidal silicic acid and the cationic starch and it is said that results improve as the Zeta potential in the initial anionic stock moves towards zero. This suggests that the binder complex is intended to have some coagulation effect upon the stock.

A process has been commercialised by the assignees of U.S. Pat. No. 4,388,150 under the trade name Compozil. The trade literature on this states that the system is an advantage over "two component systems containing long-chain linear polymers" and further states that the anionic colloidal silica is "the unique part of the system", is "not a silica pigment", and "acts to agglomerate the fines, filler and fibre already treated with the cationic starch". The system is also described in Paper, 9th Sept. 1985 pages 18 to 20 and again it is stated that the anionic silica acid is a colloidal solution that gives the system its unique properties.

Although the system can, in some processes, give a good combination of strength and process performance it suffers from a number of disadvantages. The colloidal silica, that is essential, is very expensive. The cationic starch has to be used in very large quantities. For instance the examples in U.S. Pat. No. 4,388,150 show that the amount of cationic starch and colloidal silica that are added to the stock can be as high as 15% combined dry solids based on the weight of clay (clay is usually present in an amount of about 20% by weight of the total solids in the stock). Further, the system is only successful at a very narrow range of pH values, and so cannot be used in many paper making processes.

WO86/05826 was published after the priority date of the present application and recognises the existence of some of these problems, and in particular modified the silica sol in an attempt to make the system satisfactory at a wider range of pH values. Whereas FI 67736 describes, inter alia, the use of bentonite or colloidal silica in combination with, e.g., cationic polyacrylamide and exemplified adding the cationic polyacrylamide with agitation followed by addition of some of the colloidal silica sol, in WO86/05826 the colloidal silica sol is modified. In particular, cationic polyacrylamide is used in combination with a sol of colloidal particles having at least one surface layer of aluminum silicate or aluminium-modified silicic acid such that the surface groups of the particles contain silicon atoms and aluminium atoms in a ratio of from 9.5:0.5 to 7.5:2.5. The ratio of 7.5:2.5 is achieved by making aluminium silicate by precipitation of water glass with sodium aluminate. It is stated that the colloidal sol particles should have a size of less than 20 nm and is obtained by precipitation of water glass with sodium aluminate or by modifying the surface of a silicic acid sol with aluminate ions. We believe that the resultant sol is, like the starting silicic acid sol, a relatively low viscosity fluid in contrast to the relatively thixotropic and pasty consistency generated by the use of bentonite as proposed in FI 67736.

No detailed description is given as to the process conditions that should be used for adding the polymer and the sol and so presumably any of the orders of addition described in U.S. Pat. No. 4,388,150 are suitable. Improved retention compared to, for instance, the use of a system comprising bentonite sold under the trade name "Organosorb" in WO86/05826 is demonstrated, as are improved results at a range of pH values, but the necessity to start with colloidal silica and then modify it is a serious cost disadvantage.

The use of cationic polymer in the presence of synthetic sodium aluminium silicate has been described by Pummer in Das Papier, 27, volume 10, 1973 pages 417 to 422, especially 421.

It would be desirable to be able to devise a dewatering process for the manufacture of both filled and unfilled papers that can have good burst strength and, in particular, to devise such a process that has dewatering performance (retention, drainage and/or drying) and formation properties as good as or preferably better than the Compozil system or the system of U.S. Pat. No. 4,388,150 whilst avoiding the need to use expensive materials such as colloidal silicic acid or large amounts of cationic starch, and which does not suffer from the pH restrictions inherent in the Compozil process.

According to the invention, paper or paper board is made by forming an aqueous cellulosic suspension, passing the suspension through one or more shear stages selected from cleaning, mixing and pumping stages, draining the suspension to form a sheet and drying the sheet, and the suspension that is drained includes organic polymeric material and inorganic material, characterised in that the inorganic material comprises bentonite which is added to the suspension after one of the said shear stages, and the organic polymeric material comprises a substantially linear, synthetic, cationic polymer having molecular weight above 500,000 which is added to the suspension before that shear stage in a sufficient amount. This is explained in more detail below, but is generally at least about 0.03%, based on the dry weight of the suspension. This is usually sufficient when the suspension contains at least about 0.5% cationic binder but the amount preferably is at least about 0.06% when the suspension is free of cationic binder or contains cationic binder in an amount of less than 0.5%.

The process of the invention can give an improved combination of drainage, retention, drying and formation properties, and it can be used to make a wide range of papers of good formation and strength at high rates of drainage and with good retention. The process can be operated to give a surprisingly good combination of high retention with good formation. Because of the good combination of drainage and drying, it is possible to operate the process at high rates of production and with lower vacuum and/or drying energy than is normally required for papers having good formation. The process can be operated successfully at a wide range of pH values and with a wide variety of cellulosic stocks and pigments. Although is essential in the invention to use more synthetic polymer than has conventionally been used as a polymer retention aid, the amounts of additives are very much less than the amounts used in, for instance, the Compozil process and the process does not necessitate the use of expensive anionic components such as colloidal silica or modified colloidal silica.

Whereas it is stated in the Compozil literature to be essential to use anionic colloidal silica, and whereas we confirm below that the replacement of colloidal silica by bentonite when using cationic starch does give inferior results, in the invention the use of bentonite gives improved results. Whereas the Compozil literature says that there is an advantage in that process over processes using long chain linear polymers, in the invention such polymers must be used and give improved results.

Conventional practice, for instance as mentioned by Auhorn, has established that retention is worse if the flocculated stock is subjected to shear before dewatering. In the invention, however, we subject the flocculated stock to shear and preferably we subject it to the very high shear that prevails in the centriscreen. Whereas Waech and Luner did suggest adding polymer before pigment they did not suggest this high degree of shear nor the use of bentonite and their process led to an inevitable reduction in burst strength and other practice disadvantages, all of which are avoided in the invention.

Whereas FI 67736 did mention the possibility of using bentonite, silica sol, or anionic organic polymer and did mention cationic polyacrylamide, in the only example in which cationic polyacrylamide was added colloidal silica was added before and after the polymer addition. The amount of cationic polyacrylamide would have been too low for the purposes of the present invention because of, inter alia, the prior addition of colloidal silica. Also there was no suggestion that the polymer should be added to cause flocculation, the flocs should be sheared to stable microflocs and bentonite should then be added.

Whereas WO86/05826 exemplifies a range or processes in which cationic polymer is stirred into pulp and synthetically modified silica sol is then added, that process presumably differs from the process of FI 67736 by the use of the special silica sol rather than colloidal silica or bentonite, whereas in the invention bentonite is essential and gives better results than the special sol. WO86/05826 does not suggest adding the cationic polymer before the centriscreen and the anionic component after the centriscreen.

The process of the invention can be carried out on any conventional paper making apparatus. The thin stock that is drained to form the sheet is often made by diluting a thick stock which typically has been made in a mixing chest by blending pigment, appropriate fibre, any desired strengthening agent or other additives, and water. Dilution of the thick stock can be by means of recycled white water. The stock may be cleaned in a vortex cleaner. Usually the thin stock is cleaned by passage through a centriscreen. The thin stock is usually pumped along the apparatus by one or more centrifugal pumps known as fan pumps. For instance the stock may be pumped to the centriscreen by a first fan pump. The thick stock can be diluted by white water to the thin stock at the point of entry to this fan pump or prior to the fan pump, e.g., by passing the thick stock and dilution water through a mixing pump. The thin stock may be cleaned further, by passage through a further centriscreen. The stock that leaves the final centriscreen may be passed through a second fan pump and/or a head box prior to the sheet forming process. This may be by any conventional paper or paper board forming process, for example flat wire fourdrinier, twin wire former or vat former or any combination of these.

In the invention it is essential to add the specified synthetic polymer before the stock reaches the last point of high shear and to shear the resultant stock before adding the bentonite. It is possible to insert in the apparatus a shear mixer or other shear stage for the purpose of shearing the suspension in between adding the polymer and the bentonite but it is greatly preferred to use a shearing device that is in the apparatus for other reasons. This device is usually one that acts centrifugally. It can be a mixing pump but is usually a fan pump or, preferably, a centriscreen. The polymer may be added just before the shear stage that precedes the bentonite addition or it may be added earlier and may be carried by the stock through one or more stages to the final shear stage, prior to the addition of the bentonite. If there are two centriscreens, then the polymer can be added after the first but before the second. When there is a fan pump prior to the centriscreen the polymer can be added between the fan pump and the centriscreen, or into or ahead of the fan pump. If thick stock is being diluted in the fan pump then the polymer may be added with the dilution water or it may be added direct into the fan pump.

Best results are achieved when the polymer is added to thin stock (i.e., having a solids content of not more than 2% or, at the most, 3%) rather than to thick stock. Thus the polymer may be added direct to the thin stock or it may be added to the dilution water that is used to convert thick stock to thin stock.

The addition of the large amounts of synthetic polymer causes the formation of large flocs and these are immediately or subsequently broken down by the high shear (usually in the fan pump and/or centriscreen) to very small flocs that can be termed stable microflocs.

The resultant stock is a suspension of these stable microflocs and bentonite is then added to it. The stock must be stirred sufficiently to distribute the bentonite throughout the stock. If the stock that has been treated with bentonite is subsequently subjected to substantial agitation or high shear, this will tend to reduce the retention properties but improve still further the formation. For instance the stock containing bentonite could be passed through a centriscreen prior to drainage and the product will then have very good formation properties but possibly reduced retention compared to the results if the bentonite was added after that centriscreen. Because the formation in the final sheet is usually good, in the invention, if the bentonite is added just before sheet formation, and because it is generally desired to optimise retention, it is usually preferred to add the bentonite after the last point of high shear. Preferably the polymer is added just before the final fan pump and/or final centriscreen and the stock is led, without applying shear, from the final centriscreen or fan pump to a headbox, the bentonite is added either to the headbox or between the centriscreen and the headbox, and the stock is then dewatered to form the sheet.

In some processes it is desirable to add some of the bentonite at one point and the remainder of the bentonite at a later point (e.g., part immediately after the centriscreen and part immediately before drainage, or part before the centriscreen or other device for applying the shear and part after).

The thin stock is usually brought to its desired final solids concentration, by dilution with water, before the addition of the bentonite and generally before (or simultaneously with) the addition of the polymer but in some instances it is convenient to add further dilution water to the thin stock after the addition of the polymer or even after the addition of the bentonite.

The initial stock can be made from any conventional paper making stock such as traditional chemical pulps, for instance bleached and unbleached sulphate or sulphite pulp, mechanical pumps such as groundwood, thermomechanical or chemi-thermomechanical pump or recycled pulp such as deinked waste, and any mixtures thereof.

The stock, and the final paper, can be substantially unfilled (e.g., containing less than 10% and generally less than 5% by weight filler in the final paper) or filler can be provided in an amount of up to 50% based on the dry weight of the stock or up to 40% based on the dry weight of paper. When filler is used any conventional filler such as calcium carbonate, clay, titanium dioxide or talk or a combination may be present. The filler (if present) is preferably incorporated into the stock in conventional manner, before addition of the synthetic polymer.

The stock may include other additives such as rosin, alum, neutral sizes or optical brightening agents. It may include a strengthening agent and this can be a starch, often a cationic starch. The pH of the stock is generally in the range 4 to 9 and a particular advantage of the process is that it functions effectively at low pH values, for instance below pH 7, whereas in practice the Compozil process requires pH values of above 7 to perform well.

The amounts of fibre, filler, and other additives such as strengthening agents or alum can all be conventional. Typically the thin stock has a solids content of 0.2 to 3% or a fibre content of 0.1 to 2%. The stock preferably has a solids content of 0.3 to 1.5% or 2%.

The organic, substantially linear, synthetic polymer must have a molecular weight above about 500,000 as we believe it functions, at least in part, by a bridging mechanism. Preferably the molecular weight is above about 1 million and often above about 5 million, for instance in the range 10 to 30 million or more.

The polymer must be cationic and preferably is made by copolymerising one or more ethylenically unsaturated monomers, generally acrylic monomers, that consist of or include cationic monomer.

Suitable cationic monomers are dialkyl amino alkyl -(meth) acrylates or -(meth) acrylamides, either as acid salts or, preferably, quaternary ammonium salts. The alkyl groups may each contain 1 to 4 carbon atoms and the aminoalkyl group may contain 1 to 8 carbon atoms. Particularly preferred are dialkylaminoethyl (meth) acrylates, dialkylaminomethyl (meth) acrylamides and dialkylamino-1,3-propyl (meth) acrylamides. These cationic monomers are preferably copolymerised with a non-ionic monomer, preferably acrylamide and preferably have an intrinsic viscosity above 4 dl/g. Other suitable cationic polymers are polyethylene imines, polyamine epichlorhydrin polymers, and homopolymers or copolymers, generally with acrylamide, or monomers such as diallyl ammonium chloride. Any conventional cationic synthetic linear polymeric flocculant suitable for use as a retention aid on paper can be used. The cationic polymer can contain a minor amount of anionic groups, thereby rendering it amphoteric.

The polymer can be wholly linear or it can be slightly cross linked, as described in EP 202780, provided it still has a structure that is substantially linear in comparison with the globular structure of cationic starch.

For best results the cationic polymer should have a relatively high charge density, for instance above about 0.2 preferably at least about 0.35, most preferably about 0.4 to 2.5 or more, equivalent of cationic nitrogen per kilogram of polymer. These values are higher than the values obtainable with cationic starch having a conventional relatively high degree of substitution, since typically this has a charge density of below about 0.15 equivalents nitrogen per kg starch. When the polymer is formed by polymerisation of cationic, ethylenically unsaturated, monomer optionally with other monomers the amount of cationic monomer will normally be above about 2% and usually above about 5% and preferably at least about 10% molar based on the total amount of monomers used for forming the polymer.

The amounts of synthetic linear cationic polymer used in conventional processes as retention aid, in the substantial absence of cationic binder, is typically between about 0.01 and 0.05% (dry polymer based on dry weight of paper), often around 0.02% (i.e., 0.2 k/t). Lower amounts can be used. The precise amount that is optimum depends on, inter alia, the type of pulp used to make the suspensions and the various chemical additions that may have been made to it. In these processes no significant shear is applied to the suspension after adding the polymer. If the retention and formation of the final paper is observed at increasing polymer dosage it is seen that retention improves rapidly as the dosage is increased up to, typically, 0.02% and that further increase in the dosage gives little or no improvement in retention and starts to cause deterioration in formation and drying, because the overdosing of the flocculant results in the production of flocs of increased size. The optimum amount of polymeric flocculant in conventional processes is therefore at or just below the level that gives optimum retention and this amount can easily be determined by routine experimentation by the skilled mill operator.

In the invention generally we use an excess amount of cationic synthetic polymer that is 1.1 to 10 times, usually 3 to 6 times, the amount that would have been regarded as optimum in conventional processes. The amount will therefore normally be above about 0.03% (0.3 k/t) but with some pulps and chemical additions to the pulps or suspensions lower amounts, e.g., down to 0.01% or even down to 0.005% can give useful results. For instance 0.03% is usually sufficient if the stock to which the polymer is added already contains a substantial amount, e.g., about 0.5%, cationic binder. However if the stock is free of cationic binder or only contains a small amount then the dosage of polymer will normally have to be more, usually at least about 0.06% (0.6 k/t). This is a convenient minimum even for most stocks that do contain a large amount of cationic binder. Often the amount is at least about 0.08%. The amount will usually be below about 0.5% and generally below about 0.2% with amounts of below about 0.15% usually being preferred. Best results are generally obtained with about 0.03 to 0.15, preferably 0.06 to 0.12%.

If cationic binder is present, it will be present primarily to serve as a strengthening aid and its amount will usually be below about 1%, preferably below about 0.5%. The binder may be starch, urea formaldehyde resin or other cationic strengthening aid.

The use of the excess amount of synthetic polymeric flocculant is through to be necessary to ensure that the shearing that occurs in the centriscreen or other shear stage results in the formation of microflocs which contain or carry sufficient cationic polymer to render parts at least of their surfaces sufficiently cationically charged. Surprisingly it is not essential to add sufficient cationic polymer to render the whole suspension cationic. Thus the Zeta potential of the stock can, prior to addition of the bentonite, be cationic or anionic, including for instance −25 mv. It would be normally be expected that the addition of anionic bentonite to a suspension having a significant negative Zeta potential (e.g., below −10 mv) would not give satisfactory results and U.S. Pat. No. 4,388,150 suggests that best results are achieved when the Zeta potential following the addition of the starch and the anionic silica approaches zero. The article by Liner also proposed neutralisation of the charges in the suspension by the polymer.

Whether or not a sufficient excess of cationic polymer has been added (and presumably whether or not the resultant microflocs do have a sufficient cationic charge) can easily be determined experimentally by plotting the performance properties in the process, with a fixed amount of bentonite and a fixed degree of shear, at various levels of polymeric addition. When the amount of polymer is insufficient (e.g., being the amount the gives optimum properties when added, without bentonite, after the last shear stage as in the normal prior art), the retention and other properties are relatively poor and may be worse than those optimum properties. As the amount of polymer is gradually increased a significant increase in retention and other performance properties is observed up to an optimum and this corresponds with the excess that is desired in the invention. As explained herein, the process of the invention gives substantially better retention properties than in the normal prior art (polymer alone after the final shear stage), and the amount of polymer that gives these substantially better properties is the minimum that can be used in the invention. Further increase in the amount of flocculant, far beyond the level at which the significant improvement in performance occurs, is unnecessary and, for cost reasons, undesirable. Naturally this test with the bentonite must be conducted after subjecting the flocculated suspension to very high shear so as to break it down to microflocs. As a result of having sufficient flocculant, these flocs are sufficiently stable to resist further degradation during the shearing in the centriscreen or other shear stage.

It is essential in the invention to use a cationic polymer as the first component, rather than a non-ionic or anionic polymer and, as the second component, it is essential to use bentonite rather than any other anionic particulate material. Thus colloidal silica or modified colloidal silica gives inferior results and the use of other very small anionic particles or the use of anionic soluble polymers also gives very inferior results.

The amount of bentonite that has to be added is generally in the range about 0.03 to about 0.5%, preferably 0.05 to 0.3% and most preferably about 0.08 or 0.1 to 0.2%.

The bentonite can be any of the materials commercially referred to as bentonites or as bentonite-type clays, i.e., anionic swelling clays such as sepialite, attapulgite or, preferably, montmorillinite. The montmorillinites are preferred. Bentonites broadly as described in U.S. Pat. No. 4,305,781 are suitable.

Suitable montmorillonite clays include Wyoming bentonite or Fullers Earth. The clays may or may not be chemically modified, e.g., by alkali treatment to convert calcium bentonite to alkali metal bentonite.

The swelling clays are usually metal silicates wherein the metal comprises a metal selected from aluminium and magnesium, and optionally other metals, and the ratio silicon atoms:metal atoms in the surface of the clay particles, and generally throughout their structure, is from about 5:1 to 1:1. For most montmorillonites the ratio is relatively low, with most or all of the metal being aluminium but with some magnesium and sometimes with, for instance a little iron. In other swelling clays however, some or all of the aluminium is replaced by magnesium and the ratio may be very low, for instance about 1.5 in sepialite. The use of silicates in which some of the aluminium has been replaced by iron seems to be particularly desirable.

The dry particle size of the bentonite is preferably at least about 90% below 100 microns, and most preferably at least about 60% below 50 microns (dry size). The surface area of the bentonite before swelling is preferably at least about 30 and generally at least about 50, typically 60 to 90, $m^2/gm$ and the surface area after swelling is preferably 400–800 $m^2/g$. The bentonite preferably swells by at least 15 or 20 times. The particle size after swelling is preferably at least 90% below 2 microns.

The bentonite is generally added to the aqueous suspension as a hydrated suspension in water, typically at a concentration between about 1% and 10% by weight. The hydrated suspension is usually made by dispersing powdered bentonite in water.

The choice of the cellulosic suspension and its components and the paper making conditions may all be varied in conventional manner to obtain paper ranging from unfilled papers such as tissue, newsprint, groundwood specialities, supercalendered magazine, highly filled high quality writing papers, fluting medium, liner board, light weight board to heavy weight multiply boards or sack kraft paper.

The quality of the suspension influences the amount of linear cationic polymer that is required for optimum results. For instance high quality suspensions having low cationic demand will tend to require relatively low amounts of cationic polymer for the desired effect to be obtained whereas relatively crude suspensions (for instance of the sort typically used for the manufacture of newsprint or ground wood specialities) will tend to require larger amounts of cationic polymer. Cationic demand can be determined by titrating the amount of polyethylene imine sold under the trade name Polymin SK that has to be added to give sufficient improvement in retention and high cationic demand is generally considered to be a value of 0.1% or more. Naturally, if anionic material (for instance anionic silica) is deliberately added to the suspension, or the pulp from which it is obtained, then this will tend to interact with cationic polymer that is added and so relatively large amounts of cationic polymer will be required in order to obtain a useful effect. Preferably no prior addition of anionic material is made.

As indicated above, the amount of cationic polymer tends to be reduced when the suspension already contains a cationic strengthening aid such as cationic starch, urea formaldehyde resin or other cationic binder.

Preferred processes according to the invention are those in which the suspension to which the said linear synthetic cationic polymer of molecular weight above 500,000 is added already contains other cationic polymer. This other cationic polymer may be any of the cationic binders mentioned above, typically in amounts of 0.01 to 0.5 or 1%. Relatively low molecular weight amphoteric dry strength resins, which are more cationic than anionic, can be used but in many instances the preferred materials are cationic starch or urea formaldehyde resin.

The cationic polymer (hereinafter referred to as the second polymer) that is included in the suspension before the addition of the said linear synthetic cationic polymer must be water soluble and is often a low to medium molecular weight synthetic cationic polymer. A preferred material is polyethylene imine but other suitable materials are polymers and copolymers of diallyl dimethyl ammonium chloride, or dialkyl amino alkyl (meth) acrylates and of dialkylaminoalkyl (meth) acrylamides, as well as polyamines, polydicyandiamides-formaldehyde polymers.

One preferred process according to the invention utilises a relatively crude stock having high cationic demand and/or containing significant amount of pitch. Such stocks are, for instance, those containing more than 25% by weight, usually more than 50% by weight, of mechanically derived pulps and/or deinked pulps. By mechanically derived pulps we mean groundwood, pressure refined groundwood, thermo-mechanical, chemi-thermo mechanical or any other high yield mechanically derived fibres. In the invention the second polymer is utilised either to reduce the cationic demand of the pulp or to reduce pitch problems and/or linting, or both. The second polymer may be added to the thick stock or it may be present in the pulp fed to the thick stock (for instance as a result of treating the pulp previously with the second polymer) or it may be added to the thin stock after it has been diluted (often with recycled white water) and before the addition of the said linear cationic polymer of molecular weight above 500,000.

This process is of particular value when the stock is to be used for the manufacture of newsprint, and for this purpose stock is generally substantially unfilled or only contains small amounts of filler, for instance 0 to 15% and often 0 to 10% based on the dry weight of the stock. Benefits are however also achieved if the stock contains filler in amounts to give up to 30% filler in the final paper produced.

If the second polymer is included in the pulp before the thick stock stage, it is usually added at or near the end of the pulp making process, for instance prior to final drainage or dewatering or drying ahead of the thick stock stage.

The amount of second polymer is up to 0.5% generally in the range 0.01 or 0.05 to 0.2%, based on the dry weight of the stock, and the optimum can be found by routine experimentation. Often the pulp, before treatment with the second polymer, has a cationic demand (as measured by titration with the first cationic polymer) of above 400 g/t and the second polymer is included in the stock, or ahead of the stock, in an amount to reduce the cationic demand of the thin stock to below 300 g/t before adding the first polymer.

Second polymers used for treating crude pulp for instance to reduce cationic demand and/or avoiding pitch problems and/or linting generally have relatively low molecular weight, for instance intrinsic viscosity below 5 and often below 2. Their molecular weight is generally above 50,000 and often above 100,000. Generally it is below 400,000 but it can be higher and in some instances can be up to 1 million or even 2 million.

Particularly preferred processes of the invention are those in which a second polymer of relatively low molecular weight, for instance IV below 2 and/or molecular weight below about 1 million, is present in the suspension, preferably for pitch removal or for reducing the cationic demand of a pulp of high cationic demand, and a much higher molecular weight substantially linear synthetic cationic polymer is then added, generally having IV above 4 to serve as a bridging flocculant to form flocs which are then sheared to microflocs and then bentonite is added, all as described above.

In other processes of the invention the suspension to which the substantially linear cationic polymer of molecular weight above 500,000 is to be added may already contain other polymer of this same general type, for instance having IV above 4, and the presence of such polymer will, of course, tend to reduce the amount of further polymer that needs to be added in order to form the flocs that are sheared to microflocs.

In general, these processes utilising a second cationic polymer give improved pitch and/or stickies removal, improved paper quality such as opacity and linting characteristics improved wet strength or runnability during manufacture. Furthermore the performance of the process when assessed in terms of the drainage characteristics is improved by the incorporation of the second polymer compared to the characteristics obtainable when the identical process is conducted but in the absence of the second polymer.

The paper may be sized by conventional rosin/alum size at pH values ranging between 4 and 6 or by the incorporation of a reactive size such as ketene dimer or alkenyl succinic anhydride where the pH conditions are typically between 6 and 9.

The reactive size when used can be supplied as an aqueous emulsion or can be emulsified in situ at the mill with suitable emulsifiers and stabilisers such as cationic starch.

Preferably the reactive size is supplied in combination with a polyelectrolyte in known manner. The size and the polyelectrolyte can be supplied to the user in the form of an anhydrous dispersion of the polyelectrolyte in a non-aqueous liquid comprising the size, as described in EP 141641 and 200504. Preferably the polyelectrolyte for application with the size is also suitable as the synthetic polymeric retention aid in the invention in which event the size and all the synthetic polymer can be provided in a single anhydrous composition of the polymer dispersed in the anhydrous liquid phase comprising the size.

Suitable methods of making the anhydrous compositions, and suitable sizes, are described in those European specifications. The anhydrous dispersions may be made by formation of an emulsion of aqueous polymer in oil followed by dehydration by azeotroping in conventional manner and then dissolution of the size in the oil phase, with optional removal of the oil phase if appropriate. The emulsion can be made by emulsification of an aqueous solution of the polymer into the oil phase but is preferably made by reverse phase polymerisation. The oil phase will generally need to include a stabiliser, preferably an amphipathic oil stabiliser in order to stabilise the composition.

In the following examples the following polymers are used:

A: a copolymer formed of 70% by weight acrylamide and 30% dimethyl aminoethyl acrylate quaternised with methyl chloride and having intrinsic viscosity (IV) 7 to 10.

B: a copolymer of 90 weight % acrylamide and 10 weight % dimethyl aminoethyl methacrylate having IV 7 to 10.

C: polyethyleneimine (Polymin SK B.A.S.F.)

D: polydiallyl dimethyl ammonium chloride

E: a medium molecular weight copolymer of diallyl dimethyl ammonium chloride, acrylamide 70:30 IV of 1.5

F: a quaternised dimethylaminomethyl acrylamide copolymer with 50% acrylamide and having IV 1.0

G: a copolymer of 70% by weight acrylamide and 30% sodium acrylate, IV 12

S: high molecular weight potato starch with high degree of cationic substitution CSA: colloidal silicic acid AMCSA: aluminium modified silicic acid The bentonite in each example was a sodium carbonate activated calcium montmorillonite. Examples 1 to 3 are examples of actual paper processes. The other examples are laboratory tests that we have found to give a reliable indication of the results that will be obtained when the same materials are used on a mill with the polymer being added before the centriscreen (or the final centriscreen if there is more than one) and with one bentonite being added after the past point of high shear.

EXAMPLE 1

Three retention aid systems were compared on an experimental machine designed to simulate full scale modern papermaking machine conditions. In this, thick sized stock was mixed with white water from a wire pit and was passed through a mixing pump. The resultant thin stock was passed through a dearator and was then fed by a fan pump to a flow box, from which it was flowed on to the wire to form a sheet, the drained water being collected in the wire pit and recycled.

System (I) involved the addition of 0.03% Polymer A added just after the fan pump, i.e., after last point of high shear.

System (II) involved the addition of 1.5% cationic starch just before mixing the stock with the white water, and 0.2% colloidal silica (the optimised Compozil System) just after the fan pump.

System (III) involved the addition of 0.15% Polymer A to the white water just before mixing with the stock, followed by 0.2% bentonite just after the fan pump, as a hydrated slurry.

The performance of these systems was evaluated on stock consisting of 50% bleached birch and 50% bleached pine, with 20% $CaCO_3$, at 0.7% consistency and pH 8.0 sized with an alkylketene dimer.

The first pass retention values and the web dryness after the wet presses on machine were recorded in Table 1.

TABLE 1

| System | Retention % | Dryness % |
|---|---|---|
| I | 35 | 42.75 |
| II | 74 | 44.6 |
| III | 92 | 45.75 |

This clearly demonstrates the significant advantage of the invention (system III) compared to the two prior processes (systems I and II) both as regards retention and dryness. Although the increase in dryness is numerically relatively small, commercially this difference is very significant and allows either an increase in machine speed and or decreased steam demand in the drying section.

EXAMPLE 2

The process of Example 1 was repeated using a stock and retention aid systems II and III as described in Example 1 but under acid sizing conditions using rosin alum and filled with china clay instead of $CaCO_3$. The pH of the stock was 5.0. Addition points were as described in Example 1.

TABLE 2

| System | Retention % | Dryness % |
|---|---|---|
| II | 84.0 | 45.75 |
| III | 88.0 | 46.60 |

This clearly demonstrates the significant advantage of System III over the prior process (System II), both with regard to retention and web dryness after the presses.

EXAMPLE 3

A full scale machine trial was carried out on a fourdrinier machine producing 19 t/hour of unbleached sack kraft. In this process, thick stock was diluted with white water from a silo and the stock passed through a mixing pump and dearator to a second dilution point at which further white water was added to make the final thin stock. This stock was fed to four centriscreens in parallel, all discharging into a loop that lead to the headbox that supplied the screen. The thin stock contained 0.15% cationic starch as a strengthening aid and 1% cationic urea formaldehyde wet strength resin. Machine speed was 620 m/min.

Polymer A dosage was 0.03% added to the white water at the second dilution point. The bentonite dosage was 0.2% added to the thin stock either just before the centriscreens or in the loop after the centriscreens. The results are in Table 3.

TABLE 3

| Additive | | % Retention |
|---|---|---|
| Nil | | 82.2 |
| A + Bentonite | before centriscreens | 86.8 |
| A + Bentonite | after centriscreens | 92.7 |

Under equilibrium running conditions using the retention aid system where the bentonite was added after the centriscreens, the couch vacuum was reduced by 30% and the drying steam demand by 10% compared to the system when the bentonite was added before the centriscreens. The mill reported no change in formation during the trial.

These results clearly demonstrated the benefit of adding the bentonite after shear.

EXAMPLE 4

Britt jar tests were carried out on a neutral sized stock consisting of birch (15%), spruce (30%), and 55% broke with 25% added calcium carbonate filler (the percentages for the initial solids in the stock in this and other examples are by weight of fibre). The stock had pH 8.0 and contained a conventional ketene dimer sizing agent and 0.5 cationic starch S as a strengthening aid.

The shear condition of the Britt jar was adjusted to give a first pass retention in the region of 55–60% in the absence of the additive. Cationic polyacrylamide A (if used) was added to 500 ml of thin stock (0.6% consistency) in a measuring cylinder. The cylinder was inverted four times to achieve mixing and the flocculated stock was transferred to the Britt jar tester. The flocs at this stage were very large and were clearly unsuitable for production of paper having good formation or drying properties. The stock was sheared for one minute and then bentonite (if used) was added. Retention performance was observed.

Laboratory drainage evaluations were also carried out on the same stock using a standard Schopper Reigler freeness tester. The machine orifice was plunged and time was measured for 500 ml of white water to drain from 1 liter of the same stock treated as above. The results are shown in Table 4 below.

TABLE 4

| Test | Polymer % | Bentonite % | % Retention | Drainage (secs) |
|---|---|---|---|---|
| 1 | 0 A | 0 | 56.9 | 56 |
| 2 | 0.05 A | 0 | 61.0 | 41 |
| 3 | 0.1 A | 0 | 61.4 | 28 |
| 4 | 0.15 A | 0 | 61.7 | 25 |
| 5 | 0.1 A | 0.2 | 63.7 | 14 |
| 6 | 0.15 A | 0.2 | 81.7 | 7 |

Comparison of tests 4 and 6 demonstrates the significant advantage from adding bentonite and comparison of tests 5 and 6 shows the benefit of increasing the amount of polymer A to 0.15 k/t for this particular stock. The sheared suspension in test 6 had a stable microfloc structure. The amount of polymeric in test 5 was not quite sufficient for a good structure using this particular stock.

EXAMPLE 5

The process of example 4 was repeated except that the stock was a conventional rosin alum sized stock having pH 5.5 and did not contain the cationic starch. The results are shown in Table 5.

TABLE 5

| Polymer % | Bentonite % | Drainage (secs) |
|---|---|---|
| 0 | 0 | 117 |
| 0.1 A | 0 | 70 |
| 0.15 A | 0 | 77 |
| 0.1 A | 4 | 31 |
| 0.15 A | 4 | 23 |

EXAMPLE 6

A stock was formed as in Example 4 but did not contain the starch and was tested as in Example 4. The results are shown in Table 6.

TABLE 6

| Test | Polymer % | Inorganic Additive % | % Retention |
|---|---|---|---|
| 1 | 0 | 0 | 58 |
| 2 | 1 S | 0 | 58.4 |
| 3 | 0.5 S | 0.2 CSA | 77.8 |
| 4 | 1 S | 0.2 CSA | 79.2 |
| 5 | 1 S | 0.4 Bentonite | 66.6 |
| 6 | 1 S | 0.6 Bentonite | 69.5 |
| 7 | 0.15 B | 0.2 CSA | 70 |
| 8 | 0.15 B | 0.4 Bentonite | 83.0 |
| 9 | 0.15 A | 0.2 CSA | 70.8 |
| 10 | 0.15 A | 0 | 62.3 |
| 11 | 0.15 A | 0.4 Bentonite | 84.2 |
| 12 | 0.05 B + 0.5 S | 0.4 Bentonite | 70.5 |
| 13 | 0.1 B + 0.5 S | 0.4 Bentonite | 82.2 |

Tests 3 and 4 are similar to the Compozil system and show the use of cationic starch followed by anionic colloidal silica. Comparison of test 4 with tests 5 and 6 demonstrates that replacing the anionic colloidal silica with bentonite gives worse results. Similarly comparison of tests 3 or 4 with tests 7 or 9 shows that replacing the cationic starch with a synthetic flocculant gives worse results.

Comparison of tests 12 and 13 indicates that the amount of synthetic flocculant in test 12 is inadequate. Tests 8, 11 and 13 demonstrate the excellent results obtainable in the invention. The advantage of the processes of the invention using bentonite (tests 8, 11, 13) over the use of colloidal silica (tests 7, 9) is apparent.

EXAMPLE 7

A stock was formed as in Example 4 but with no filler and was treated with polymer A before the shearing and with bentonite or specified filler after the shearing. The results are shown in Table 7.

TABLE 7

| Test | Polymer % | Inorganic % | Retention B/W Solids | Drainage Time (secs) |
|---|---|---|---|---|
| 1 | 0 | 0 | 1023 | 33 |
| 2 | 0.1 A | 0 | 705 | 24 |
| 3 | 0.1 A | 0.05 Bentonite | 315 | 10 |
| 4 | 0.1 A | 0.1 Bentonite | 205 | 5 |
| 5 | 0.1 A | 0.2 Bentonite | 180 | 5 |
| 6 | 0.1 A | 0.1 Clay | 710 | 25 |
| 7 | 0.1 A | 0.1 $CaCO_3$ | 700 | 25 |
| 8 | 0.1 A | 0.1 $TiO_2$ | 740 | 25 |

This clearly demonstrates the superiority of the use of bentonite over other pigmentary fillers. Much better drainage values can be obtained by increasing the amount of clay, $CaCO_3$ or $TiO_2$ filler that is added after the polymer, but this is impractible and the sheet strength is reduced.

EXAMPLE 8

Laboratory drainage evaluations were carried out as in Example 4 on a 0.5% stock comprised of bleached kraft (60%) bleached birch (30%) and broke (10%). The stock was sized with an alkenyl succinic anhydride size at pH 7.5.

The treated stocks were prepared by adding the desired quantity of dilute polymer solution (0.05%) to 1 liter of stock in a measuring cylinder. The cylinder was inverted four times to effect mixing and transferred to a beaker and sheared mechanically with a conventional propellor stirrer (1,500 rpm) for 1 minute.

After shearing, the stock was transferred back to the measuring cylinder and bentonite as a 1% hydrated slurry was added as required to give the appropriate dose. The cylinder was again inverted four times to effect mixing and transferred to the modified Schopper Reigler apparatus for drainage evaluation.

In the cases where only polymer was added, the polymer treated stock was transferred to the Schopper Reigler apparatus immediately after cylinder inversion and was not subjected to shear.

A range of cationic polymers was evaluated at a constant dose level of 0.1% dry polymer on dry weight of paper. Table 8 shows the results achieved with and without further addition of bentonite.

TABLE 8

| Additive | Drainage Time (secs) No Bentonite | Bentonite Addition 0.2% |
|---|---|---|
| Blank | 71 | 68 |
| Polymer C | 35 | 19 |
| Polymer D | 53 | 32 |
| Polymer E | 46 | 22 |
| Polymer F | 30 | 12 |

Clearly all the polymers gave advantageous drainage benefits to the stock when added alone as single additions, but all show substantial further improvement when the polymer was added before shearing and bentonite is added after shearing.

The size was provided initially as an anhydrous dispersion as described in EP 141641. For instance polymer E could be formulated into a dispersion as in examples 1 to 5 of that specification and the resultant dispersion in oil could be dispersed into water, thereby dissolving the polymer and emulsifying the size, by use of an oil in water emulsifying agent, so as to form an aqueous concentrate that is then added to the cellulosic suspension.

EXAMPLE 9

Retention evaluations were carried out on a stock consisting of 60% Bleached Kraft, 40% Bleached Birch and 10% Broke with 20% added calcium carbonate. The stock consistency was 0.7% and a pH of 8.0.

The retention evaluation was carried out using the Britt Dynamic Drainage Jar using the following procedure:

The first component, (cationic starch or cationic polyacrylamide) was added to a 1 liter measuring cylinder containing starch. The cylinder was inverted four times to effect mixing and transferred to the Britt Jar. The treated stock was sheared for 1 minute at a stirrer speed of 1500 rpm. The second component was then added (bentonite or polysilicic acid), the stirrer speed was immediately reduced to 900 rpm and mixing continued for 10 seconds. Drainage was allowed to start and the drained white water was collected, filtered and weighed dry. The total first pass retention was calculated from the data.

The results are shown in Table 9.

TABLE 9

| Test | Polymer % | Inorganic % | % Retention |
|---|---|---|---|
| 1 | Nil | Nil | 65 |
| 2 | 0.1 A | Nil | 81 |
| 3 | 0.1 A | 0.15 CSA | 85.4 |
| 4 | 0.1 A | 0.2 CSA | 85.9 |
| 5 | 0.1 A | 0.3 CSA | 86.2 |
| 6 | 0.1 A | 0.2 Bentonite | 93.3 |
| 7 | 0.5 S | 0.15 CSA | 86.2 |
| 8 | 0.1 S | 0.15 CSA | 88.2 |
| 9 | 0.5 S | 0.2 Bentonite | 79.5 |

TABLE 9-continued

| Test | Polymer % | Inorganic % | % Retention |
|---|---|---|---|
| 10 | 0.1 S | 0.2 Bentonite | 81.2 |

Comparison of tests 3 to 5 with test 2 shows that the late addition of colloidal silica does improve the retention and so, as indicated in WO86/05826, some benefit does follow from the addition of colloidal silica after synthetic linear polymer. However comparison of test 6 with tests 3 to 5 shows that bentonite gives very much better results than colloidal silica in these circumstances.

Comparison of tests 7 and 8 with tests 9 and 10 shows that when using cationic starch instead of a synthetic polymer colloidal silica gives better results. These results confirm the requirement in the Compozil process for using colloidal silica and suggest that a synergic effect exists between the cationic polymer and bentonite, but not between cationic starch and bentonite.

EXAMPLE 10

Drainage times were recorded as in Example 4 on a stock formed of 50% bleached birch, 50% bleached kraft with 20% added calcium carbonate and having pH 7.5. In test 1, neither polymer nor particulate additive was added. In tests 2 to 15, 0.1% of Polymer A was added before the shearing. In tests 3 to 16, the specified amounts of various anionic additives were added. In tests 14, 0.2% bentonite was added but, instead of using Polymer A, 0.1% non-ionic polymer was used in test 14 and 0.1% anionic polymer was used in test 15. In test 16, polymer A and bentonite were added simultaneously before the shearing. The results are in Table 10.

TABLE 8

| Test | Anionic Additive | Drainage Time (secs) |
|---|---|---|
| 1 | NIL | 56 |
| 2 | NIL | 34 |
| 3 | 0.2% Bentonite | 6 |
| 4 | 0.2% CSA | 12 |
| 5 | 10% China Clay | 9 |
| 6 | 10% Kieselguhr | 21 |
| 7 | 0.5% alkali-swellable polyacrylic aqueous emulsion | 30 |
| 8 | 0.1% alkali-swellable polyacrylic aqueous emulsion | 42 |
| 9 | 1% water-swellable polyacrylamide dispersion in oil | 20 |
| 10 | 0.5% water-swellable polyacrylamide dispersion in oil | 25 |
| 11 | 0.2% water-swellable polyacrylamide dispersion in oil | 23 |
| 12 | 1% sodium polyacrylate crosslinked fines | 27 |
| 13 | 1% polyacrylamide crosslinked fines | 40 |
| 14 | 0.2% bentonite (after non-ionic) | 52 |
| 15 | 0.2% bentonite (after anionic) | 54 |
| 16 | 0.2% bentonite (simultaneous) | 30 |

This confirms that bentonite has unique properties compared to other organic and inorganic anionic materials or colloidal silicic acid, provided it is added after the flocculated system has been sheared before the addition of bentonite.

EXAMPLE 11

Retention tests were carried out using the Britt jar tester. Thin stock containing 20% china clay was placed in the Britt jar and 0.1% Polymer A was added. This was then sheared at 1000 rpm for 30 seconds. 0.2% bentonite was added and after allowing 5 seconds for mixing the test was carried out.

The procedure was repeated except 20% clay was added at the end instead of the 0.2% bentonite.

Standard 100 gsm sheets were prepared using the above two systems. Retention and Burst strength were recorded and results are shown in Table 11.

TABLE 11

| Additives | % Retention | Burst Strength KPA |
|---|---|---|
| 20% china clay + 0.1% Polymer A + 0.2% bentonite | 79.0 | 197 |
| 0.1% Polymer A + 20% china clay | 76.0 | 99 |

This shows that although the late addition of high levels of china clay can give reasonable retention results compared to the bentonite, it has a dramatic bad effect on sheet strength.

EXAMPLE 12

Laboratory evaluations were carried out to compare different modes of addition of the polymer when using retention aid System III of Example 2.

Samples of thick stock and whitewater were obtained from a mill producing publishing grade papers from bleached chemical pulps filled with calcium carbonate and sized with alkylketene dimer size.

Thick stock consistency was 3.5% and the white water was 0.2%. The thick stock and white water were combined proportionately to give a thin stock consistency of 0.7%.

Laboratory retention evaluation were carried out using a Britt Dynamic Jar Tester as follows:

For the control without any retention aid, thick stock and white water were combined in the Britt Jar and sheared for 30 seconds at 1000 rpm. When the polymer was added to thick stock, the flocculated thick stock was sheared for 30 seconds at 1000 rpm. After addition of the white water, further mixing was carried out for 5 seconds at 1000 rpm followed by the bentonite additions which was mixed for a further 5 seconds before testing. When the polymer was added to the white water, this was sheared for 30 seconds at 1000 rpm followed by addition of thick stock, this was then mixed for a further 5 seconds before bentonite addition which as before was mixed for 5 seconds before testing. The results obtained are shown in Table 12.

Polymer A dosage used was 0.2% and bentonite dosage was 0.2%.

TABLE 12

| Order of Addition | % Retention |
|---|---|
| Thick stock + White water | 50.9 |
| Thick stock + White water + Polymer A + Bentonite | 70.5 |
| Thick stock + Polymer A + White water + Bentonite | 56.5 |
| White water + Polymer A + Thick stock + Bentonite | 71.4 |

This shows the benefit of adding the polymer to the thin stock, or to the dilution water for the thin stock, in preference to adding the polymer to thick stock.

EXAMPLE 13

Aluminium modified silicic acid sol AMCSA was prepared by treatment of colloidal silicic acid with sodium aluminate according to WO86/0526 (AMCSA). It was compared at two pH values with CSA and bentonite, after Polymer A, as follows.

The paper making stock was prepared from bleached kraft (50%), bleached birch (50%) and beaten to 45° SR, and diluted to 0.5% consistency. The thin stock was split into two portions. The pH of one portion was 6.8, and hydrochloric acid was added to the other portion to adjust the pH to 4.0.

600 mls of stock was added to a Beritt jar and 0.5% solution of polymer A added to give a dose level of 0.1% dry polymer on dry paper. The flocculated thin stock was sheared for 60 seconds at 1500 rpm in the Britt jar after which the contents were transferred to a 1 liter measuring cylinder and the anionic component was added. The cylinder was inverted four times to achieve mixing and the contents were transferred to a Schopper Riegler apparatus where the machined orifice had been blocked. The time for 400 mls to drain was recorded.

The results are shown in Tables 13 and 14.

TABLE 13

| Stock pH 6.8 | | | |
|---|---|---|---|
| Polymer A Dose % | Anionic | Anionic Dose % | Time (seconds) |
| 0 | — | — | 75 |
| 0.1 | — | — | 47 |
| 0.1 | AMCSA | 0.1 | 19 |
| 0.1 | AMCSA | 0.2 | 18 |
| 0.1 | AMCSA | 0.4 | 23 |
| 0.1 | CSA | 0.1 | 20 |
| 0.1 | CSA | 0.2 | 18 |
| 0.1 | CSA | 0.4 | 23 |
| 0.1 | Bentonite | 0.2 | 7 |

TABLE 14

| Stock pH 4.0 | | | |
|---|---|---|---|
| Polymer A Dose % | Anionic | Anionic Dose % | Time (seconds) |
| 0 | — | — | 73 |
| 0.1 | — | — | 47 |
| 0.1 | AMCSA | 0.1 | 22 |
| 0.1 | AMCSA | 0.2 | 17 |
| 0.1 | AMCSA | 0.4 | 19 |
| 0.1 | CSA | 0.1 | 33 |
| 0.1 | CSA | 0.2 | 27 |
| 0.1 | CSA | 0.4 | 23 |
| 0.1 | Bentonite | 0.2 | 7 |

This shows that aluminium modified colloidal silicic acid (AMCSA) prepared according to WO86/05826, performs as well as colloidal silicic acid (CSA) described in U.S. Pat. No. 4,388,150 at pH 6.8, but performs better than colloidal silicic acid (CSA) at pH 4.0. The results show that bentonite performs significantly better than either CSA or AMCSA at both pH values. The results demonstrate the synergism that exists specifically between cationic synthetic polymers and bentonite when the stock is sheared after the polymer addition.

EXAMPLE 14

The effect of addition of soluble anionic polymer G instead of bentonite in the retention aid system was evaluated in the laboratory on a stock consisting of bleached chemical pulps, calcium carbonate and alkylketene dimer size. Both retention and drainage tests were carried out.

Retention tests were carried out using a Britt Dynamic Jar. The required amount of Polymer A was added to 500 mls of thin stock and sheared in the Britt Jar at 1000 rpm for 30 seconds. This was followed by the addition of bentonite or Polymer G at the appropriate dose level and after allowing 5 seconds for mixing the test was carried out.

Vacuum drainage tests were carried out by taking thick stock and treating it as above but after mixing in the bentonite or polymer the stock was transferred into a Hartley Funnel fitted with a filter paper. The Hartley Funnel was attached to a conical flask fitted with a constant vacuum source. The time was then recorded for the stock to drain under vacuum until the pad formed on the filter paper assumed a uniform matt appearance corresponding to removal of excess water.

Results are as shown in Table 15.

TABLE 15

| Additive | % Retention | Vacuum Drainage Time (seconds) |
|---|---|---|
| Nil | 70.8 | 80 |
| 0.1% Polymer A + 0.2% Bentonite | 95.8 | 6 |
| 0.1% Polymer A + 0.1% Polymer G | 88.4 | 26 |
| 0.1% Polymer A + 0.2% Polymer G | 88.4 | 30 |
| 0.1% Polymer A + Zero | 84.8 | 14 |

The addition of the anionic Polymer G only slightly improves the retention and has an adverse effect on drainage compad to Polymer A on its own. Polymer A followed by bentonite was significantly more effective with regard to both retention and drainage.

EXAMPLE 15

A stock was formed from bleached Kraft (80%) and Broke (20%) together with an addition of 35% filler (china clay) and the stock was rosin/alum sized and had pH 4.5.

A first additive was added to the stock which was then stirred for one minute at 1000 rpm. The second additive was then added and the stock stirred at 1000 rpm for only 5 seconds. Retention and drainage evaluations were carried out using the general technique shown in example 4 of the application. It is desirable for the drainage time to be as low as possible and the retention to be as high as possible.

One of the components that was used was bentonite at a rate of 0.2% (2 kilo bentonite per tonne dry stock) while the other additive was 0.1 or 0.2% of cationic polymer having intrinsic viscosity 6.4 and formed from 92% by weight acrylamide and 8% methyl chloride quaternary salt of dimethylaminoethyl acrylate. The results are shown in the following table.

TABLE 16

| Test | First Addition | Second Addition | Drainage Time | % Retention |
|---|---|---|---|---|
| A | nil | nil | 126 | 56 |
| B | 0.2% polymer | 0.2% bentonite | 41 | 78 |
| C | 0.2% bentonite | 0.2% polymer | 65 | 70 |
| D | 0.1% polymer | 0.2% bentonite | 52 | 72 |
| E | 0.2% bentonite | 0.1% polymer | 69 | 67 |

Tests B and D are in accordance with the invention while tests C and E are in accordance with the order of addition described in U.S. Pat. No. 4,305,781. Comparison of test C with test B and comparison of test E with test D clearly demonstrates the great disadvantages in both drainage time and retention obtainable by the invention, compared to the order of addition in U.S. Pat. No. 4,305,781.

EXAMPLE 16

A series of Britt jar tests were conducted in the same general manner as described above using a suspension of 100% bleached kraft fibre having a freeness of 420 ml CSF and sufficient of a mixture of equal parts calcium carbonate and talc to give an ash content of 20%, and 1% cationic starch (dry weight based on fibre) and 0.1% ketene dimer size (active on dry) with a stock consistency of 0.72% and a pH of 7.8. The polymer is polymer I, which is an acrylamide dimethylaminoethyl acrylate methyl chloride quaternised containing 75 weight percent acrylamide and having IV 7.5. Tests were conducted adding polymer after shearing, and polymer before shearing with bentonite after, and the following results were obtained.

TABLE 17

| Addition | First Pass Retention % | Drainage Time |
|---|---|---|
| Control | 69.3 | 82 |
| 0.02% I | 78.4 | 44 |
| 0.01% I then 0.2% bentonite | 82.6 | 14 |
| 0.03% I then 0.2% bentonite | 96.3 | 14 |

EXAMPLE 17

The process of example 16 was repeated using a pulp of 100% bleached kraft, china clay to give 20% ash, rosin alum size, 1% cationic starch, 0.81% consistency and pH 4.8. The results are set out in Table 18. Polymer J is similar to polymer I except that the IV was 6.0.

TABLE 18

| Addition | First Pass Retention % | Drainage Time |
|---|---|---|
| Control | 65.3 | 45 |
| 0.02% J | 71.4 | 42 |
| 0.005% J then 0.2% bentonite | 79.1 | 18 |
| 0.01% J then 0.2% bentonite | 83.0 | 15 |
| 0.015% J then 0.2% bentonite | 86.3 | 15 |
| 0.02% J then 0.2% bentonite | 90.5 | 12.5 |
| 0.03% J then 0.2% bentonite | 96.5 | 11 |

These two examples show that even with quite small amounts of polymer I and J added before the shear, followed by bentonite after the shear, better retention is obtained than when using the same polymer alone but added after the shear.

EXAMPLE 18

A 100% mixed waste stock having a consistency of 0.5% was prepared. Drainage tests were conducted on the stock using a modified Shopper Riegler freeness tester, the time for 600 mls of backwater to drain from the stock sample being measured. The stock was subjected to shear and the drainage was measured. In one test no additions were made before or after the shear. In other tests bentonite was added after the shear and polymer I and/or polymer C was added before the shear. When both polymers I and C were added, C was added considerably ahead of polymer I.

The results are as follows.

TABLE 19

| Polymer C | Polymer I | Bentonite | Drainage |
|---|---|---|---|
| 0 | 0 | 0 | 74 |
| 0 | 0.04% | 0.2% | 32 |
| 0.02% | 0.04% | 0.2% | 18 |
| 0.04% | 0.04% | 0.2% | 13 |
| 0.04% | 0 | 0.2% | 51 |

EXAMPLE 19

A process similar to the preceding example was conducted using a stock having a high mechanical fibre content, and in particular being a 50:50 groundwood:-bleached kraft pulp having a consistency of 1.0%. In addition to measuring the drainage time as in the previous example, a pitch count was made (in particles/ml by the Allen method). The following results were obtained.

TABLE 20

| Polymer C | Polymer I | Bentonite | Drainage | Pitch Count | Percentage Pitch Reduction |
|---|---|---|---|---|---|
| 0 | 0 | 0 | 80 | $5.8 \times 10^6$ | |
| 0 | 0.025% | 0.2% | 49 | $1.7 \times 10^6$ | 70% |
| 0.025% | 0.025% | 0.2% | 35 | $1.2 \times 10^6$ | 79% |
| 0.05% | 0.025% | 0.2% | 31 | $5.1 \times 10^5$ | 91% |

These examples clearly demonstrate the value of adding, for instance 0.01 to 0.1%, generally around 0.02 to 0.07%, polyethylene imine so as to reduce the amount of high molecular weight (for instance IV above 4) cationic retention aid that is required for good drainage and retention and so as to counteract the effect of stock having cationic demand and, especially, high pitch count.

Similar benefits are obtainable when using, for instance, a polymer of diallyldimethyl ammonium chloride, for instance a copolymer with a minor amount of acrylamide, or when using other relatively low molecular weight (e.g., below 2 million or intrinsic viscosity below about 2 dl/g) polymers of dialkylaminoalkyl (meth) acrylates as acid or quaternary ammonium salts, often copolymerised with acrylamide.

Another pre-treatment, that is of particular use in the manufacture of newsprint or groundwood specialities is one in which the crude pulp if first treated with bentonite and then with a substantially non-ionic polymer (as in EP 17353) and, generally after shearing, is then treated with the linear synthetic cationic polymer of molecular weight above 500,000 used in the invention followed by shearing followed by the application of bentonite, all as described above. This is a process of particular value in the manufacture of newsprint and groundwood specialities, typically having a final filler content of not more than about 15%, and generally not more than about 10%, and made from pulp having high cationic demand.

EXAMPLE 20

Newsprint is made using a stock based on 3% kraft, 17% magnefite, 38% thermomechanical pulp and 42% groundwood, and to which 20% broke has been added. High molecular weight polymer is added, in some tests, just before the last shear stage and bentonite is added, in some tests, after the last shear stage. Low molecular weight polymer is added to the thin stock soon after it is diluted from the thin stock.

In these tests the low molecular weight polymer is polymer K which is a solution polymer of about IV 1 dl/g and formed from about 20% acrylamide and 80% by weight diallyl dimethyl ammonium chloride. The high molecular weight polymers are L, which is 70% acrylamide, 30% methyl chloride quaternised dimethylaminoethyl acrylate IV 8, and polymer M which is 95% acrylamide and 5% methyl chloride quaternised dimethylaminoethyl acrylate IV 11. The drainage rate for each of the treated suspensions is measured, with the best results being those that have the highest drainage figure. The results are as follows.

TABLE 21

| Polymer K | High MW Polymer | Bentonite | Drainage |
|---|---|---|---|
| 0 | 0 | 0 | 205 |
| 0.2% | 0 | 0 | 195 |
| 0.2% | 0 | 0.2% | 300 |
| 0.2% | 0.05% L | 0.2% | 335 |
| 0.2% | 0.05% M | 0.2% | 340 |
| 0 | 0.05% M | 0.2% | 325 |

These results clearly demonstrate the benefit in the manufacture of newsprint from adding high molecular weight cationic polymer immediately before shear and bentonite after shear even when the high molecular weight polymer only has a relatively low cationic charge, and they also show that a useful result can be obtained when the high molecular weight polymer is replaced by a lower molecular weight polymer having molecular weight above 500,000, but that best results are obtained using a combination of both.

We claim:

1. A process in which paper or paper board is made by forming an aqueous cellulosic suspension, passing the suspension through one or more shear stages, said shear stages being selected from cleaning, mixing and pumping stages, draining the suspension to form a sheet and drying the sheet and in which the suspension that is drained includes organic polymeric material that is flocculant or retention aid and inorganic material, and in which the inorganic material comprises bentonite which is added in an amount of at least 0.03% to the suspension after one of the said shear stages, and the organic polymeric retention aid or flocculant comprises a substantially linear synthetic cationic polymer having molecular weight above 500,000 and having a charge density of at least about 0.2 equivalents of nitrogen per kg polymer which is added to the suspension before that shear stage in an amount that is effective to give improved retention upon the addition of bentonite.

2. A process in which paper or paper board is made by forming an aqueous cellulosic suspension, passing the suspension through one or more shear stages, said shear stages being selected from cleaning, mixing and pumping stages, draining the suspension to form a sheet and drying the sheet and in which the suspension that is drained includes organic polymeric material that is flocculant or retention aid and inorganic material, and in which the inorganic material comprises bentonite which is added in an amount of at least 0.03% to the suspension after one of the said shear stages, and the organic polymeric retention aid or flocculant comprises a substantially linear synthetic cationic polymer having molecular weight above 500,000 and having a charge density of at least about 0.2 equivalents of nitrogen per kg polymer which is added to the suspension before that shear stage in an amount such that flocs are formed by the said addition of the polymer and the said flocs are broken by the shearing to form microflocs that resist further degradation by the shearing and that carry sufficient cationic charge to interact with the bentonite to give better retention that is obtainable when adding the polymer alone after the last point of high shear.

3. A process according to claim 2 in which the amount of the said polymer is above about 0.01%.

4. A process according to claim 2 in which the said cleaning stage is a centriscreen, the said pumping stage is a fan pump and the said mixing stage is a mixing pump.

5. A process according to claim 2 in which the bentonite is added after the one or more shear stages.

6. A process according to claim 2 in which the one or more shear stages comprise a centriscreen, the said polymer is added to the suspension before the centriscreen and the bentonite is added after the centriscreen.

7. A process according to claim 2 in which the said polymer is selected from polyethylene imine, polyamine epichlorhydrin products, polymer of diallyl dimethyl ammonium chloride and cationic acrylic polymers.

8. A process according to claim 2 in which the said polymer is a cationic polymer having intrinsic viscosity above 4 dl/g and formed from acrylic monomers comprising dialkylaminoalkyl (meth) -acrylate or -acrylamide, as acid or quaternary salt.

9. A process according to claim 1 in which the aqueous cellulosic suspension to which the said polymer is added already contains other, second, cationic polymer and the said polymer flocculant or retention aid is added in an amount of at least about 0.01%.

10. A process in which paper or paper board is made by forming an aqueous cellulosic suspension containing low molecular weight cationic polymeric material, adding high molecular weight cationic polymeric material, passing the suspension through one or more shear stages, said shear stages being selected from cleaning, mixing and pumping stages, adding bentonite in an amount of at least 0.03% to the suspension after one of the said shear stages, draining the suspension to form a sheet and drying the sheet, and in which the low molecular weight cationic polymer has intrinsic viscosity below 2 dl/g, the high molecular weight cationic polymer is a substantially linear synthetic cationic polymer having intrinsic viscosity above 4 dl/g and is added in an effective amount of above about 0.01%, and the bentonite is added in an amount of at least 0.03%.

11. A process according to claim 10 in which the said low molecular weight cationic polymer is selected from polyethylene imine and polymers formed from monomers comprising a monomer selected from the group diallyl dimethyl ammonium chloride, dialkylaminoalkyl (meth) acrylate (as acid or quaternary salt) and dialkylaminoalkyl (meth) acrylamide as acid addition or quaternary salt.

12. A process according to claim 10 in which the said low molecular weight polymer is selected from polyethylene imine and polymers of diallyl dimethyl ammonium chloride and the said high molecular weight polymer is a polymer of dialkylaminoalkyl (meth) acrylate as acid addition or quaternary salt.

13. A process according to claim 10 in which the aqueous cellulosic suspension is formed from a pulp having a cationic demand of above 0.1%.

14. A process according to claim 10 in which the amount of the high molecular weigh cationic polymer is above 0.03%.

15. A process according to claim 10 in which the said aqueous cellulosic suspension is made by dilution with white water of a thick stock containing the said low molecular weight polymer.

16. A process according to claim 10 in which the said high molecular weight polymer is added before the last point of high shear and the said bentonite is added after the last point of high shear.

* * * * *